US010543675B2

(12) United States Patent
Rogerson

(10) Patent No.: US 10,543,675 B2
(45) Date of Patent: Jan. 28, 2020

(54) WIPER BLADE FOR PRINTER ROLLER

(71) Applicant: Mark Rogerson, Auckland (GB)

(72) Inventor: Mark Rogerson, Auckland (GB)

( * ) Notice: Subject to any disclaimer, the term of this patent is extended or adjusted under 35 U.S.C. 154(b) by 0 days.

(21) Appl. No.: 15/470,257

(22) PCT Filed: Sep. 24, 2015

(86) PCT No.: PCT/GB2015/052772
§ 371 (c)(1),
(2) Date: Mar. 27, 2017

(87) PCT Pub. No.: WO2016/046559
PCT Pub. Date: Mar. 31, 2016

(65) Prior Publication Data

US 2017/0210121 A1 Jul. 27, 2017

(30) Foreign Application Priority Data

Sep. 26, 2014 (GB) ..... 1417029.4
Jan. 9, 2015 (GB) ..... 1500331.2

(51) Int. Cl.
*B41F 35/02* (2006.01)

(52) U.S. Cl.
CPC ..... *B41F 35/02* (2013.01)

(58) Field of Classification Search
CPC ..... B41F 35/02
USPC ..... 101/425
See application file for complete search history.

(56) References Cited

U.S. PATENT DOCUMENTS 2,302,490 A * 11/1942 Curtis ..... B41F 35/04 101/425
2,948,012 A 9/1960 Scott
2,972,767 A 2/1961 Smith
3,089,175 A * 5/1963 Hinder ..... B60S 1/38 101/120
4,151,797 A * 5/1979 Dunsirn ..... B41F 9/1036 101/169

(Continued)

FOREIGN PATENT DOCUMENTS

BR 1380187 * 1/1975 ..... B41F 35/02
DE 3834932 4/1990

(Continued)

OTHER PUBLICATIONS

ULIPO Search Report, Application No. GB1516666.3, dated Jul. 11, 2016, 4 pages Jul. 11, 2016.

*Primary Examiner* — Anthony H Nguyen
(74) *Attorney, Agent, or Firm* — Jackson Walker LLP

(57) ABSTRACT

A blade assembly of a waste catchment system for a roller comprises a support plate for attachment to a tray of the waste catchment system and a blade holder. The blade holder is configured to receive a blade having a free edge adapted to engage with the roller to be cleaned. The blade holder includes a channel for receiving and retaining the blade, the blade being insertable into and removable from the blade holder by sliding with respect thereto. The blade holder and the blade comprise respective co-operating elements configured to permit sliding of the blade relative to the blade holder in the longitudinal direction of the blade and to constrain the blade against movement relative to the blade in a direction perpendicular to the said longitudinal axis.

19 Claims, 14 Drawing Sheets

(56) References Cited

U.S. PATENT DOCUMENTS

| | | | | |
|---|---|---|---|---|
| 4,241,691 | A * | 12/1980 | Hopfe | B01D 29/6469 101/365 |
| 4,254,709 | A * | 3/1981 | Arnolds | B41F 35/04 101/169 |
| 5,224,424 | A * | 7/1993 | Layland | B41F 35/04 101/157 |
| 6,267,801 | B1 * | 7/2001 | Baake | B01D 53/228 55/DIG. 5 |
| 6,356,724 | B1 * | 3/2002 | Michlin | G03G 15/0812 399/106 |
| 9,096,054 | B2 * | 8/2015 | Moncavage | B41F 15/44 |
| 2004/0163587 | A1 | 8/2004 | Rata | |
| 2005/0160551 | A1 | 7/2005 | Kochenrath | |
| 2010/0186770 | A1 | 7/2010 | Johnson et al. | |

FOREIGN PATENT DOCUMENTS

| | | |
|---|---|---|
| DE | 19508298 | 9/1996 |
| DE | 29913598 | 8/1999 |
| GB | 1399057 | 6/1975 |
| WO | 2007113492 | 10/2007 |

* cited by examiner

WIPER BLADE FOR PRINTER ROLLER

RELATED APPLICATIONS

This application claims priority to PCT/GB2015/052772, filed on Sep. 24, 2015, which claims priority to GB 1417029.4, filed on Sep. 26, 2014, and GB 1500331.2, filed on Jan. 9, 2015. PCT/GB2015/052772 is herein incorporated by reference in its entirety.

FIELD OF THE INVENTION

The present invention relates to a wiper blade for removing waste materials from a roller and in particular from a printer roller.

BACKGROUND OF THE INVENTION

In the printing industry, waste material is removed from rollers by using a wiper blade. The wiper blade includes a tip for engaging a rotating roller to scrape any waste material, typically ink, from the roller.

Typically, waste material scraped off the roller is directed to a collection tray.

It has been common for wiper blades to be formed of rubber tip that is vulcanised onto a steel plate. However, the printing industry has begun to use polyurethane tipped wiper blades because of their useful properties in the removal of certain materials. Also, polyurethane has been found to have desirable wear resistance and resistance to ultraviolet (UV) radiation. However, polyurethane does not vulcanise well.

WO2007/113492 describes an alternative construction of wiper blade and support plate. The support plate includes a jaw that is adapted to receive a corresponding part of the wiper blade. The jaw is then crimped so as to grip the wiper blade and secure it to the plate. Adhesive may be applied to one or both of the support plate and the wiper blade to ensure that the wiper blade is secured fast with the support blade.

The solvents used in printing inks cause the wiper blades to wear and therefore the blades must be replaced from time to time. Whilst the device described in WO2007/113492 does provide an alternative to vulcanisation for attaching the blade to the support plate, nevertheless, when the blade is worn and needs to be changed, the whole device must be removed from the printer. This involves removing a plurality of bolts (fifteen for example), each of which is likely to need to be cleaned of ink prior to removal. In most printers, in order to change the blade the waste ink tray into which waste material removed from the roller by the wiper is deposited must be emptied and cleaned to allow the blade assembly to be removed, as the bolts attaching the blade assembly to the tray pass through the tray.

It will be appreciated that changing the wiper blade is a time consuming and messy task.

It would be desirable to provide an improved wiper blade assembly.

EP1112187 describes a waste catchment system which incorporates a wiper assembly comprising a wiper blade attached to a support plate. The blade is configured to receive a lip of a replaceable tray of the waste catchment system so that in use the blade is attached to the replaceable tray.

It would be desirable to provide an improved wiper blade assembly suitable for use with a waste catchment system of the type described in EP1112187.

SUMMARY OF THE INVENTION

According to an aspect of the invention there is provided a blade assembly of a waste catchment system for a roller as specified in Claim 1.

It is preferred the blade holder includes a channel, the blade received and retained in the channel.

It is preferred that the co-operating elements include at least one indent in one of the blade and the blade holder and at least one protrusion so shaped and dimensioned as to engage the at least one indent to slide in the longitudinal direction of the indent. Advantageously, the or each indent is a rebate.

The blade holder may include a closed end adapted to limit the said sliding of the blade relative to the blade holder.

The blade assembly may further comprise blade retaining means associated with the blade holder said blade retaining means having a first position in which the blade may slide relative to the blade holder, and a second position in which the blade retaining means prevents sliding of the blade relative to the blade holder.

Advantageously, the blade retaining means comprises a plate that is pivotally mounted at one end of the blade holder. The blade retaining means may further comprise a lock configured to secure the plate in the blade retaining position.

Preferably, in the second position the blade retaining means is removed from the blade holder.

The blade assembly may further comprise a sloping surface configured to engage the blade and direct waste material removed from the roller by the blade towards the tray. The sloping surface may be a part of the blade holder or is a part of a component mounted in the blade holder. The blade assembly may be adapted to attach to a liner for lining the tray.

Preferably, the blade assembly and one edge of the tray are provided with co-operating male/female elements, the male/female elements providing a releasable sealing connection therebetween.

Preferably, the co-operating male/female elements are a friction push-fit one into the other.

Advantageously, the blade assembly includes a deformable component and wherein the deformable component provides at least a part of the female element.

Preferably, a longitudinal face of the deformable element is situated adjacent a longitudinal face of the blade and wherein the female element is comprised in the deformable component.

Advantageously, the deformable component is configured such that when the male element is inserted into the female element the longitudinal face of the deformable component is pressed against the adjacent face of the blade.

Advantageously, the deformable component is formed of a plastics material or rubber or polyurethane.

It is preferred that the deformable component includes the sloping surface.

The blade holder may include a channel and a part of the deformable component is received in the channel.

One of the channel and the deformable component may include an indent and the other a protrusion, the indent and protrusion co-operating to secure the deformable component in the blade holder. The protrusion may be a longitudinally extending lip or barb.

The deformable component may form a first part of the female element and the blade holder forms a second part of the female element.

The second part of the female element may be situated beneath the sloping surface.

The blade assembly may be attached to the liner magnetically.

It is preferred that at least one of the blade assembly and the liner is provided with a magnetic element, and where both the blade assembly and liner are not provided with magnetic elements, one of the blade assembly and liner is provided with a magnetically attractive metallic element.

Where both the blade assembly and the liner are provided with a magnetic element, the polarities of the respective elements may be configured such that the liner locates in a desired position with respect to the blade assembly. Each of the magnetic elements may include repeating alternating polarities.

In one embodiment, the co-operating elements comprise a recess in the blade and the blade holder includes a protrusion, the protrusion engaging in the recess.

It is preferred that the blade includes an indent extending from the recess and wherein the blade includes an element for engaging with the indent.

Preferably, the blade holder includes a channel, the blade received and retained in the channel.

The blade may include a sloping surface configured to engage the roller and direct waste material removed from the roller by the blade towards the tray.

The sloping surface may be formed in part by a lip extending from the blade.

Preferably, the lip is configured so that it extends beyond an attachment member attaching the blade assembly to the liner.

According to another aspect of the invention there is provided a waste catchment system as specified in Claim 33. Preferably, the waste catchment system further comprises a liner for lining the tray, the blade assembly releasably attachable to the liner.

BRIEF DESCRIPTION OF THE DRAWINGS

In the drawings, which illustrate the prior art and exemplary embodiments of the wiper blade assembly of the invention.

DESCRIPTION OF THE PRIOR ART

Figure 1:
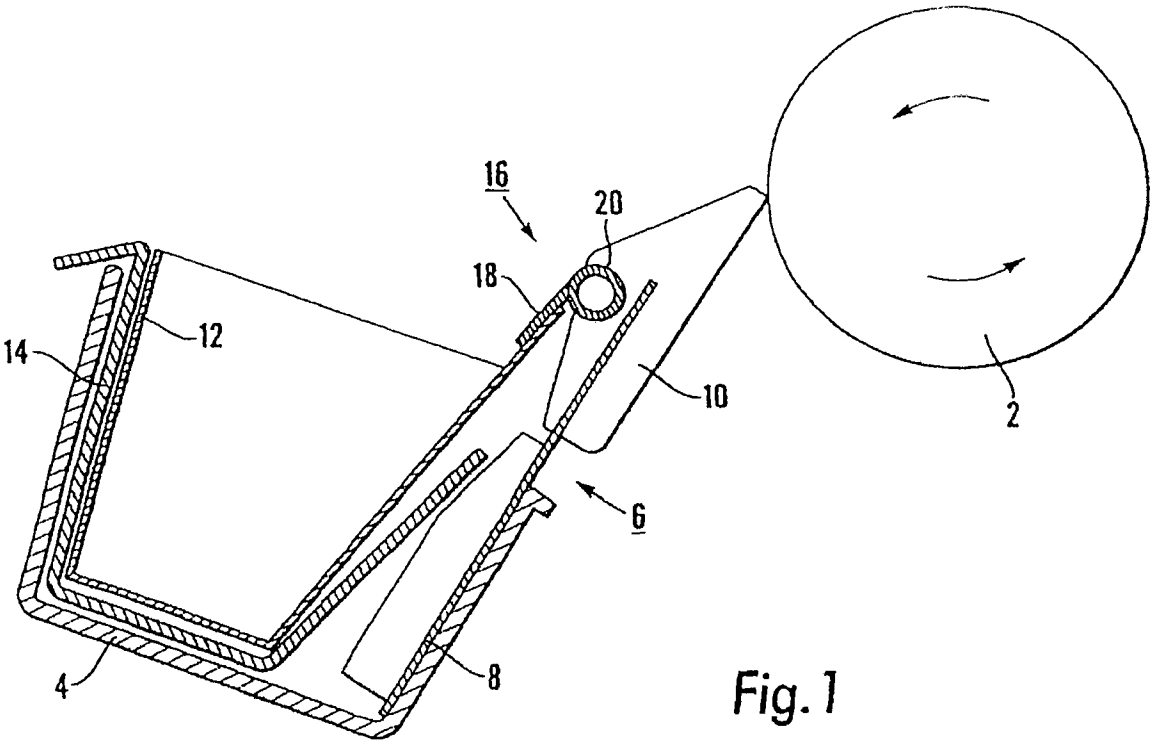
FIG. 1 illustrates a waste catchment system of the prior art.

FIG. 1 illustrates a waste catchment system for receiving waste material from the surface of a rotating roller 2, which is typically part of an industrial printing press mechanism.

The waste catchment system includes a wash up tray 4 and a blade assembly 6, which comprises a support plate 8 and a blade 10, which scrapes waste material from the roller 2. This arrangement is common not only to the waste catchment system of EP1112187, but also waste catchment systems that do not use the liner described in EP1112187.

Figure 2:
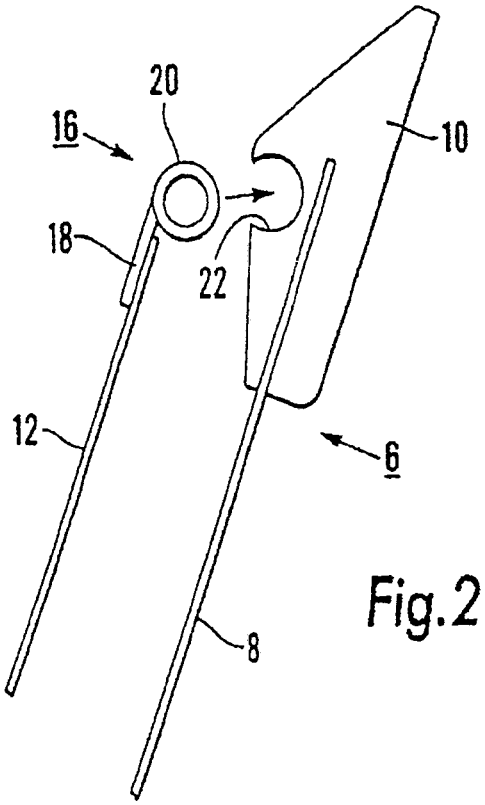
FIG. 2 illustrates a wiper blade assembly of the prior art.

The waste catchment system described in EP1112187 also includes a liner 12 which is mounted in a support element 14. The liner 12 includes an attachment strip 16 which comprises a flange portion 18 that is attached to the liner 12 and a bead portion 20 which is configured to engage with and attach to a recess 22 in the blade 10. This is best shown in FIG. 2.

DETAILED DESCRIPTION OF THE PREFERRED EMBODIMENTS

Figure 6:
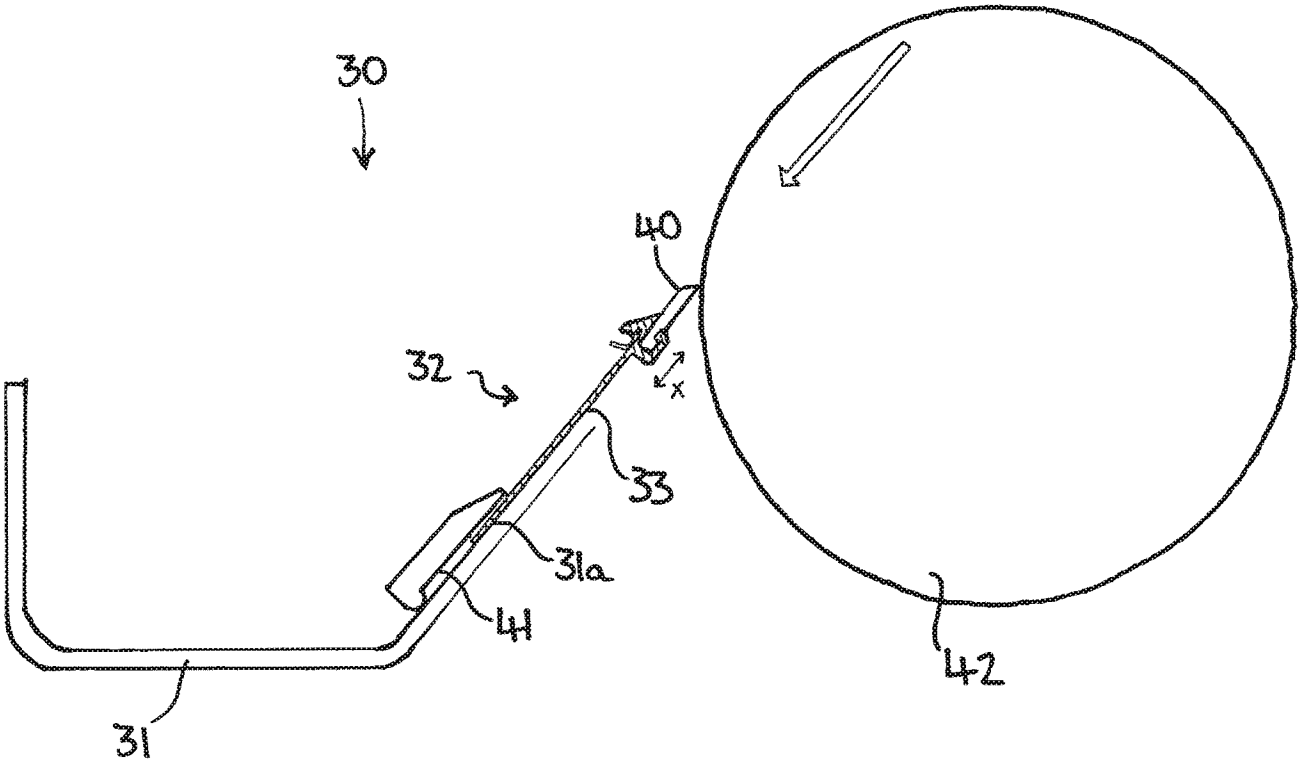
FIG. 6 is a schematic representation of a waste catchment system of the present invention.

Referring now to FIG. 6, there is shown a waste catchment system 30 according to the invention comprising a wash up tray 31 and a blade assembly 32, which comprises a support plate 33 and a blade 40, which scrapes waste material from the roller 42.

The support plate 33 rests on an inner wall 31*a* of the wash up tray 31 and is attached thereto by a bracket 41.

Figure 3:
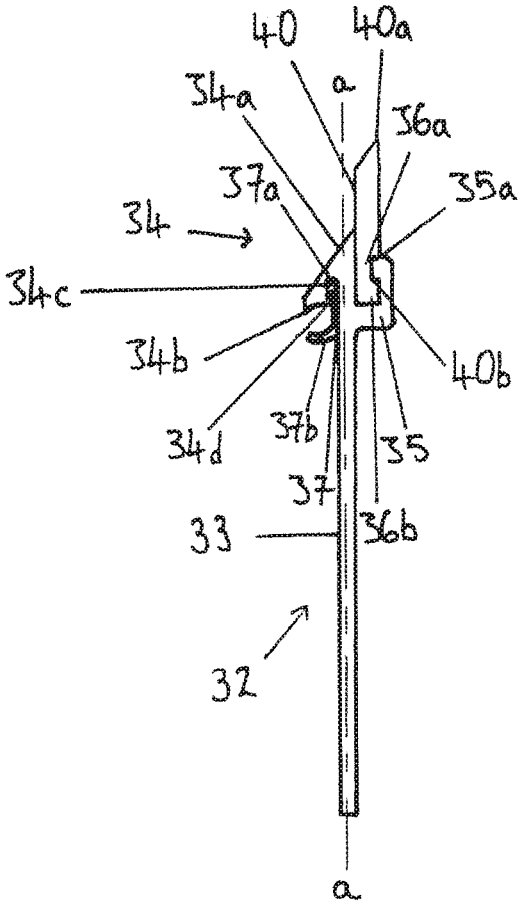
FIG. 3 is a side view of a first embodiment of a wiper blade assembly of the invention.

Referring also to FIG. 3, the support plate 33 includes a blade holder 34 that is configured to receive one end of the blade 40. The blade holder 34 comprises a leg 35 which provides a channel for receiving a part of the blade 40. The leg 35 includes a portion 35*a* so that the channel comprises a first channel portion 36*a* and a second channel portion 36*b*, the channel portion 36*b* being wider than the channel portion 36*a*.

The blade 40 includes a tip portion 40*a* for engaging the surface of the roller 42. One surface of the blade 40 includes a rebate 40*b* which is situated on the blade 40 such that with the end face of the blade 40 sitting on the bottom of channel 36*b* the portion 35*a* engages with the rebate 40*b*.

With the blade 40 mounted in the blade holder 34 the blade 40 is restricted against movement in the direction indicated by arrow "X" in FIG. 6. However, as can be seen from FIG. 5*b* in particular, the blade 40 may be withdrawn from or inserted into the blade holder 34 by moving the blade 40 in the direction indicated by arrow "Z" in FIG. 5*b*.

Figure 5A:
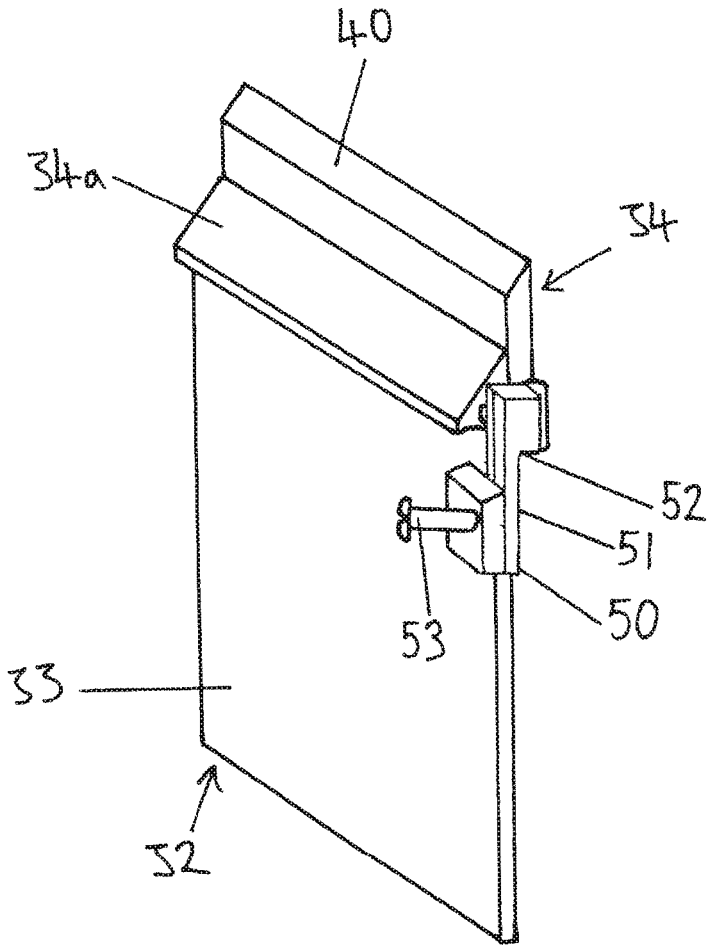
FIG. 5*a* is a schematic representation of the wiper blade assembly illustrated in FIG. 3 viewed from one side.
Figure 5B:
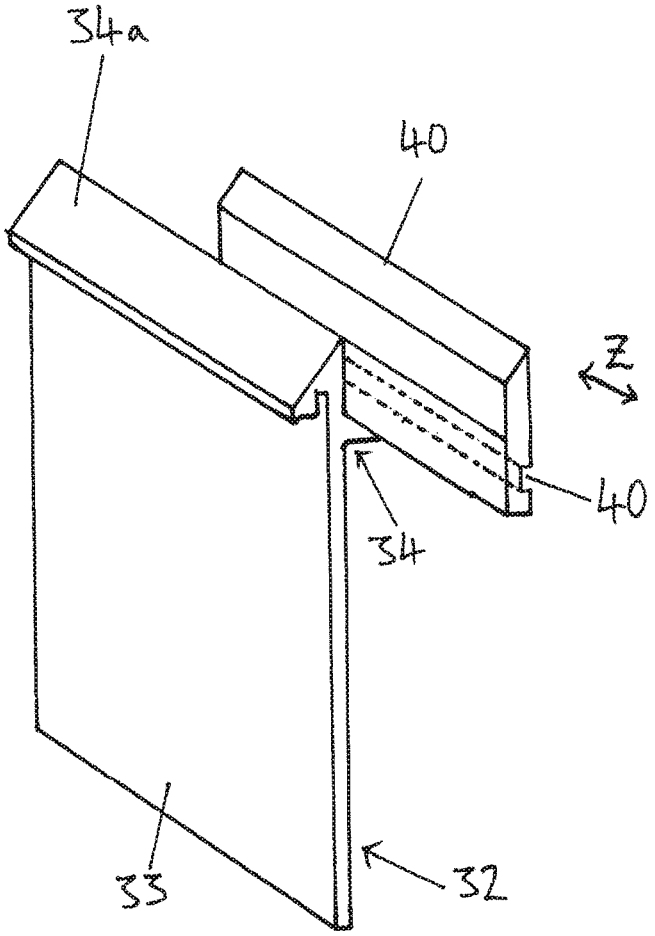
FIG. 5*b* is a schematic representation of the wiper blade assembly illustrated in FIG. 3 with the blade element in a state of partial insertion.
Figure 5C:
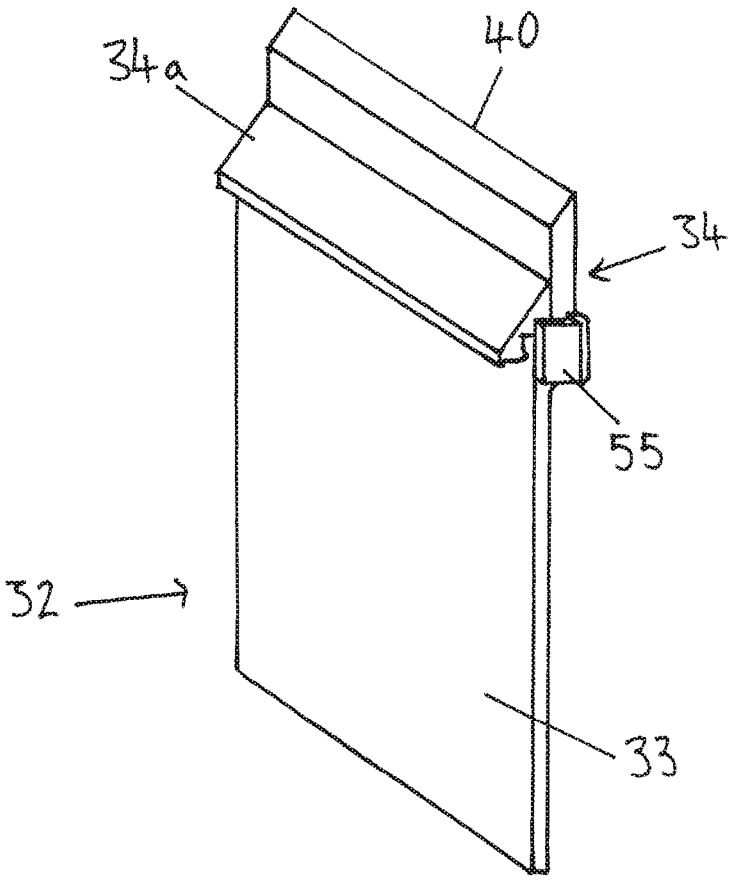
FIG. 5*c* is a schematic representation of the wiper blade assembly illustrated in FIG. 3 viewed from the other side to FIG. 5*a;*

Whilst providing for the blade 40 to be removed from the blade holder 34, it is also necessary to constrain the blade 40 against movement in the direction "Z" whilst the blade is in scraping engagement with the surface of the roller 2. This is because the roller 2 can transfer forces to the blade 40 causing it to move in the direction "Z". FIGS. 5*a* to 5*c* illustrate the means by which the the blade 40 may be constrained against movement in the direction "Z" whilst in scraping engagement with a roller 2, yet removed from the blade holder 34 when required.

As shown in FIG. 5*a*, the support plate 33 mounts a removable closure member 50 which includes a leg 51 having a foot 52 at the free end thereof, the foot 52 covering the end of the channel formed by the leg 35 of the blade holder 34. The closure member is removably attached to the support plate 33, in the illustrated example by a screw 53.

FIG. 5*c* shows the blade assembly 32 from the other side thereof. It can be seen that the channel formed by the leg 35 is permanently closed by a plate 54, which provides that the blade 40 may only be removed from one side of the blade assembly, by moving the closure member 50. Alternatively, instead of plate 54 permanently closing the channel, the plate 54 may be replaced by another closure member 50.

Figure 4:
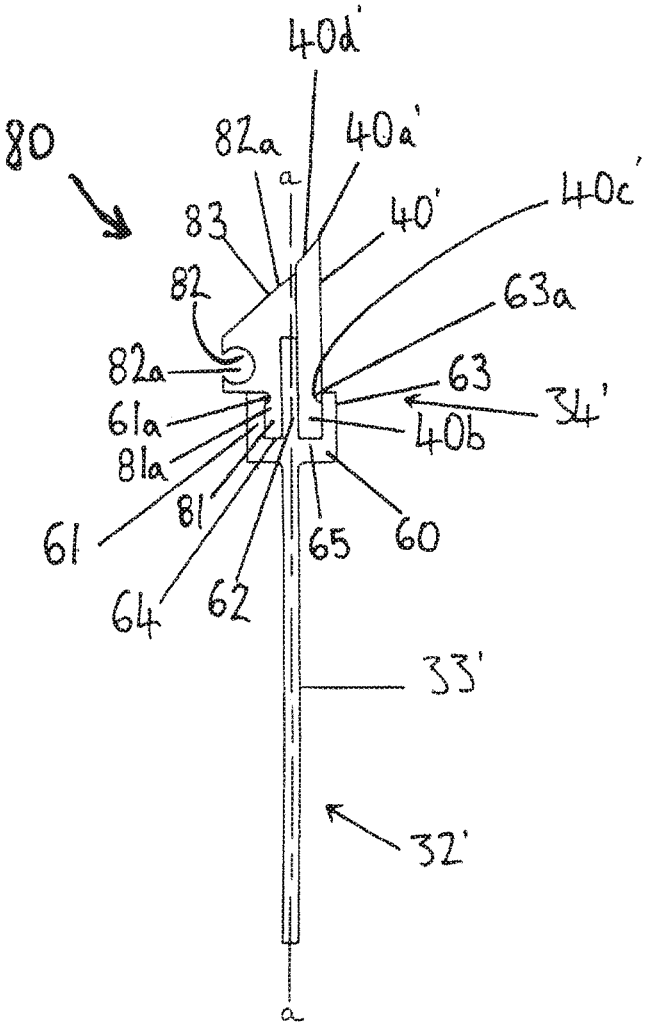
FIG. 4 is a side view of a second embodiment of a wiper blade assembly of the invention.

FIGS. 3 and 4 illustrate two different embodiments of a blade assembly 32, 32'. Both embodiments provide for attachment of the bead 20 shown in FIGS. 1 and 2 to the blade holder 34.

In the embodiment shown in FIG. 3 the blade holder 34 includes a wall 34*a* which lies at an angle of approximately 45 degrees to the axis a-a of the support plate 33. The blade holder 34 further includes a channel 34*c* enclosed by the wall 34*a* and the support plate 33. The channel 34*c* includes a lip 34*d* extending from wall 34*a* towards the support plate 33. The channel 34*c* receives one end of a flexible member 37. The end of the flexible member 37 received in the channel 34*c* includes a barb 37*a*. As can be seen from FIG. 3, the flexible member is configured such that the free end of the barb 37*a* engages with the lip 34*d*, thereby securing the flexible member 37 in the channel 34*c*. The flexible member 37 may be inserted into and/or removed from the channel 34 from one end thereof in the same manner as the blade 40. Alternatively, the flexible member 37 may be pushed through the opening between the lip 34*d* and the support plate 33, the barb 37*a* being compressed as it passes through said opening. Once inserted, engagement of the barb 37*a* with the the lip 34*d* secures the flexible member 37 in place.

The wall 34 includes a curved portion 34*b*. The flexible member 37 also includes a curved portion 37*b*. Together the curved portion 34*b* of the wall 34 and the curved portion 37*b* of the flexible member 37 are adapted to receive and retain the bead 20 of the liner 12 shown in FIGS. 1 and 2.

The embodiment of FIG. 4 is an alternative configuration that provides the same function as the embodiment illustrated in FIG. 3.

The blade assembly 32' comprises a support plate 33' and a blade holder 34' at one end thereof. The blade holder 34' is configured to receive the blade 40' and a bead attachment member 80.

The blade holder 34' comprises a base 60 and three spaced apart walls 61, 62 and 63. The wall 62 is situated substantially centrally between two outer walls 61, 63. The free end of the central wall 62 extends beyond the free ends of outer walls 61, 63 in the direction of the axis a-a.

The outer wall 63 includes a lip 63*a* projecting from the inner face of the outer wall 63 towards the central wall 62. In the illustrated example the lip 63*a* extends from the upper edge of the outer wall 63.

The outer wall 61 includes a similar lip 61*a* projecting from the inner face of the outer wall 61 towards the central wall 62. In the illustrated example the lip 61*a* extends from the upper edge of the outer wall 61.

The outer walls 61, 63 and central wall 62 together form two substantially parallel channels 64, 65. The channel 64 receives a part of the bead attachment member 80 in the form of a rib 81. The rib 81 includes a rebate 81*a* extending in the longitudinal direction of the bead attachment member 80. The rebate 81*a* is so shaped and dimensioned as to engage with the lip 61*a* of the blade holder 34'.

The bead holder 80 further includes a longitudinally extending channel 82, which is configured to receive the bead 20 illustrated in FIG. 1 so that the bead 20 may be introduced into and removed from the said channel 82. The channel 82 includes a longitudinally extending opening 82*a*. The bead 20 is introduced into or removed from the channel 82 through the opening 82*a*, which deforms to permit this.

The blade 40' is secured in the channel 65 formed between the central wall 62 and outer wall 63. The blade 40' includes a longitudinally extending rib 40'*b*, which itself includes a longitudinally extending rebate 40'*c*. The rib 40'*b* sits in the channel 65 with the lip 63*a* engaging with the rebate 40'*c*.

As can be seen from FIG. 4, the bead holder 80 includes a surface 83 which lies on a slope of approximately 45 degrees to the axis a-a of the support plate 33'. The wiper blade 40' also includes a sloping surface 40'*d* extending in the longitudinal direction of the blade 40'. The lower edge of the sloping surface 40'*d* is substantially aligned with the upper edge of the sloping surface 83. This is so that waste material flowing off the sloping surface 40'*d* flows onto the sloping surface 83, and with the bead 20 engaged in the channel 82 into the waste collection liner.

The channel 82 in cross-section forms the major part of a circle. It is preferred that the radius thereof is fractionally smaller than the radius of the bead 20. This is so that when the bead 20 is inserted into the channel 82, the channel 82 and hence the bead holder 80 is slightly deformed. It has been found that such an arrangement assists in pressing the upper free edge of the sloping surface 83 against the wiper blade 40', which is advantageous in avoiding waste material removed by the wiper blade 40' finding its way between the adjacent parallel surfaces of the wiper blade 40' and the bead holder 80.

Both the wiper blade 40' and the bead holder 80 are removed from and inserted into the channels between the centre wall 62 and the outer walls 61, 63 by sliding the wiper blade 40', bead holder 80 in the manner described with reference to the wiper blade 40 in FIGS. 5*a* and 5*b*.

Figure 7:
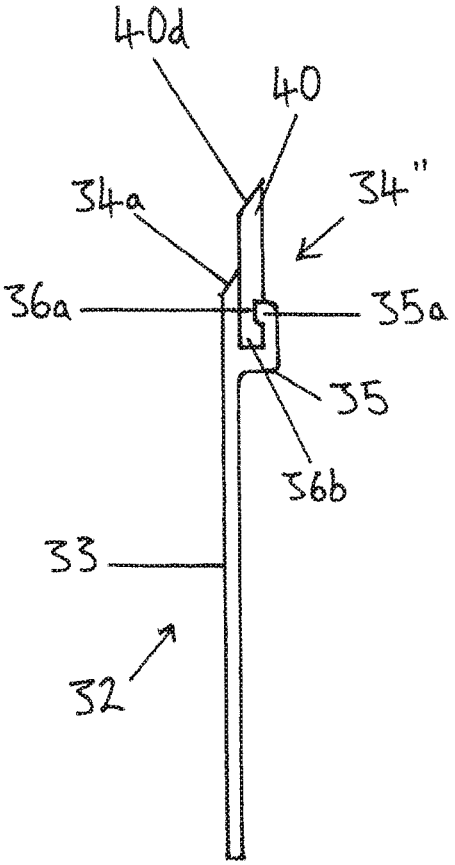
FIG. 7 is a schematic side view of a wiper blade assembly according to another aspect of the invention.

FIG. 7 illustrates an alternative embodiment of the wiper blade assembly of the invention. In this example, the blade assembly is of substantially the same design as that shown in FIG. 3, except that the blade assembly 32 is not required or designed to connect to a wash up tray liner. The blade holder 34" of the blade assembly 32 shown in FIG. 7 therefore omits those parts of the blade holder 34 shown in FIG. 3 provided for attachment to the wash up tray liner. The wall 34*a* is therefore an extension of the support plate 33, the tip of the wall 34*a* engaging with the blade 40. The embodiment shown in FIG. 7 may be provided with a closure member 50 and end stop 55 as shown in FIGS. 5*a* to 5*c*.

Figure 8:
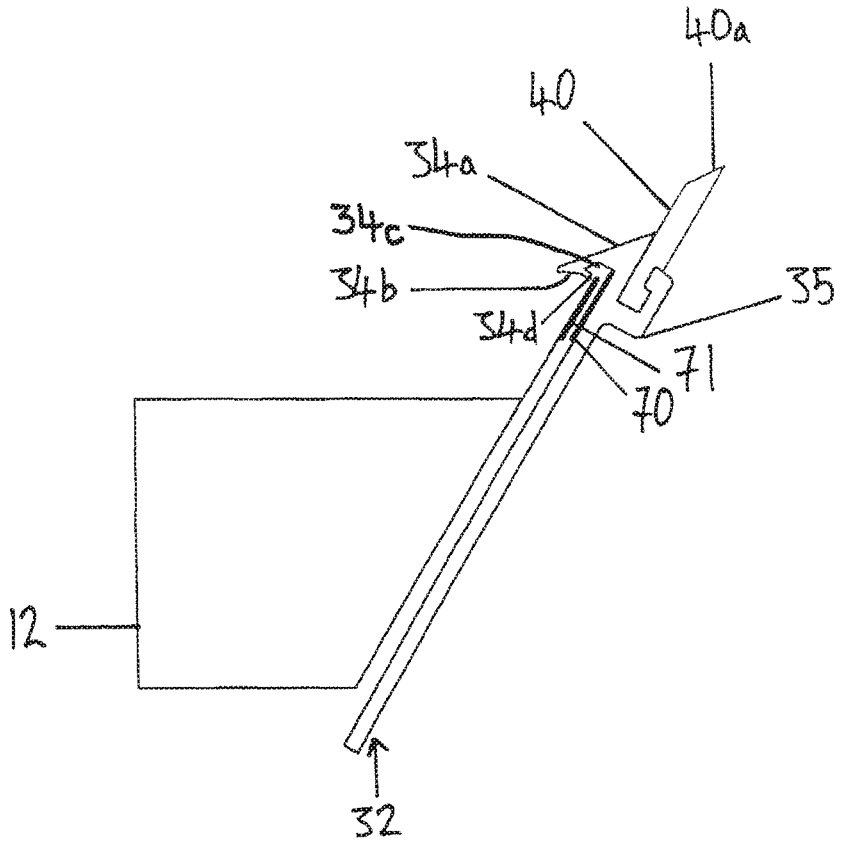
FIG. 8 is a schematic side view of another alternative embodiment of the invention.

FIG. 8 illustrates another alternative embodiment of the wiper blade assembly of the invention. In this example, the blade assembly is of substantially the same design as that shown in FIGS. 3*a* and 5*a* to 5*c*, except that the means of attachment of the blade assembly 32 to the wash up tray liner 12 is magnetic. At least one of the wash up tray liner and the blade assembly 32 is provided with a magnetic element 70 and where only one of the wash up tray liner 12 and the blade assembly 32 is provided with a magnetic element 70 the other is provided with a metallic element 71 that is subject to magnetic attraction. In the embodiment illustrated in FIG. 8 the metallic element 71 is attached to the outer surface of the wash up tray liner 12. In use, the free end of the wash up tray liner 12 on which the metallic strip 71 is mounted sits behind and in close proximity to the lip 34*d*. The ink and solvent collected by the wiper blade 40 will fall from the lip 34*d* onto the inner surface of the wash up tray liner 12 in which it is collected. In the illustrated embodiment, the magnetic element 70 is attached to the blade assembly 32 by adhesive. The aforementioned arrangement for directing the flow of ink and solvent to the wash up tray liner mitigates against such ink and solvent coming into contact with the adhesive holding the magnetic element 70 in place. It is preferred that the magnetic element 70 is a strip corresponding substantially in size to the metallic strip 71. Note, the magnetic element may be provided on the liner with the metallic element 71 being provided on, or forming part of the blade assembly.

Figure 9:
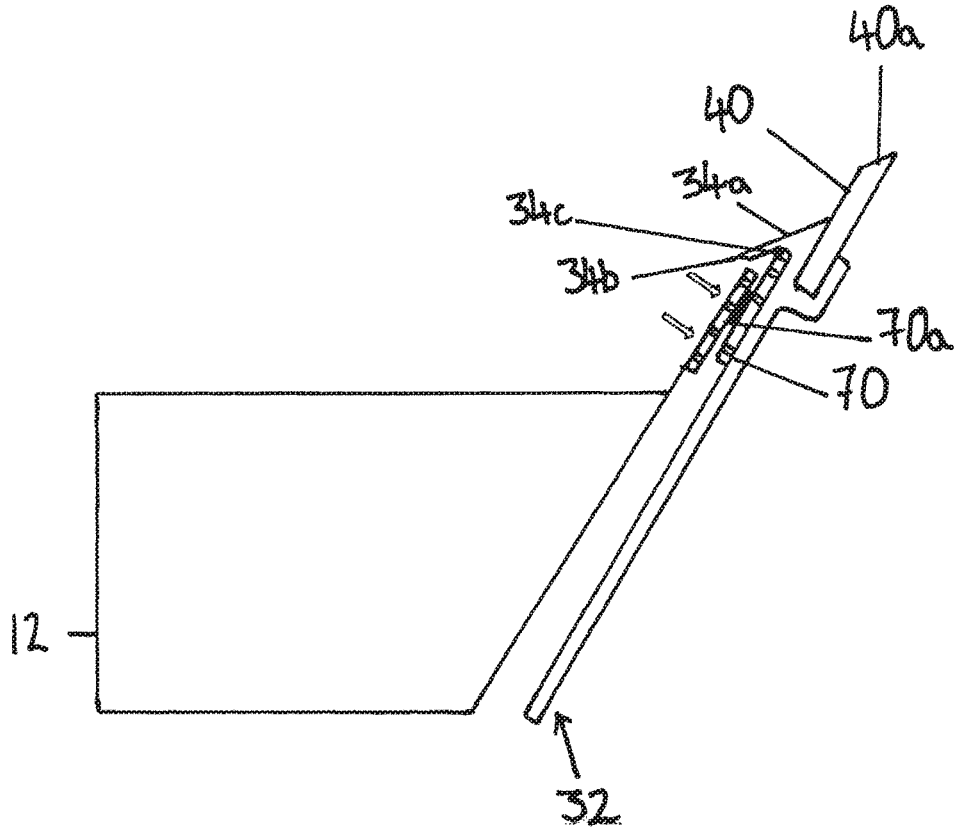
FIG. 9 is a schematic side view of the embodiment of the invention illustrated in FIG. 8 comprising magnetic elements on both the blade and the tray liner.

It is particularly advantageous that the metallic strip 71 should also be a magnetic element. In this case, by suitable arrangement of the polarity of the magnetic elements of the wash up tray liner and the blade assembly 32 the components being connected together can be caused to attach to one another such that they are correctly positioned. This is illustrated in FIG. 9. The magnetic elements 70, 70*a* are provided with alternating polarities and are configured respectively so that when the free end of the wash up tray 12 is in the channel 34*c* the south poles of the magnetic strip 70 are aligned with the north poles of the magnetic strip 70*a*. By so arranging the polarity of the magnetic elements, the free edge of the wash up tray liner 12 is caused to take up the desired position in the channel 34*c*. This is advantageous because if the wash up tray liner is incorrectly positioned, i.e. not sufficiently far into the channel 34*c*, ink and solvent removed by the blade may find its way onto the metallic strip or magnetic element, and this may cause the adhesive attaching the magnetic element and/or metallic strip to the wash-up tray liner or blade assembly to fail. Whilst a person fitting the wash up tray liner 12 to the blade assembly 32 can position a metallic strip 71 correctly, an arrangement that ensures the correct fitting of the wash up tray liner mitigates against human error. The magnetic elements 70, 70*a* are formed of a magnetic tape which may be provided with adhesive to one side thereof for attachment to a surface. It can be seen from FIG. 9 that the magnetic elements 70, 70*a* provide repeating and alternating north and south polarities. It will also be understood that the provision of magnetic elements 70, 70*a* as well as assisting in correct positioning of the free edge of the wash up tray in the channel 34*c*, they also provide an obvious indication of incorrect positioning to a fitter, since slight misalignment is not permitted by the magnet polarities. Either the free edge of the wash up tray is correctly positioned in the channel 34*c*, or it is significantly out of position.

FIGS. 8 and 9 show the blade assembly attached to the wash up tray liner 12. The magnetic attachment illustrated in FIG. 8 may be adapted to an arrangement of the type shown in FIG. 6, where a wash up tray liner is not used. If the wash up tray 31 is metallic and attracted to a magnet, the blade assembly must be provided with a suitably located magnetic element.

Figure 10:
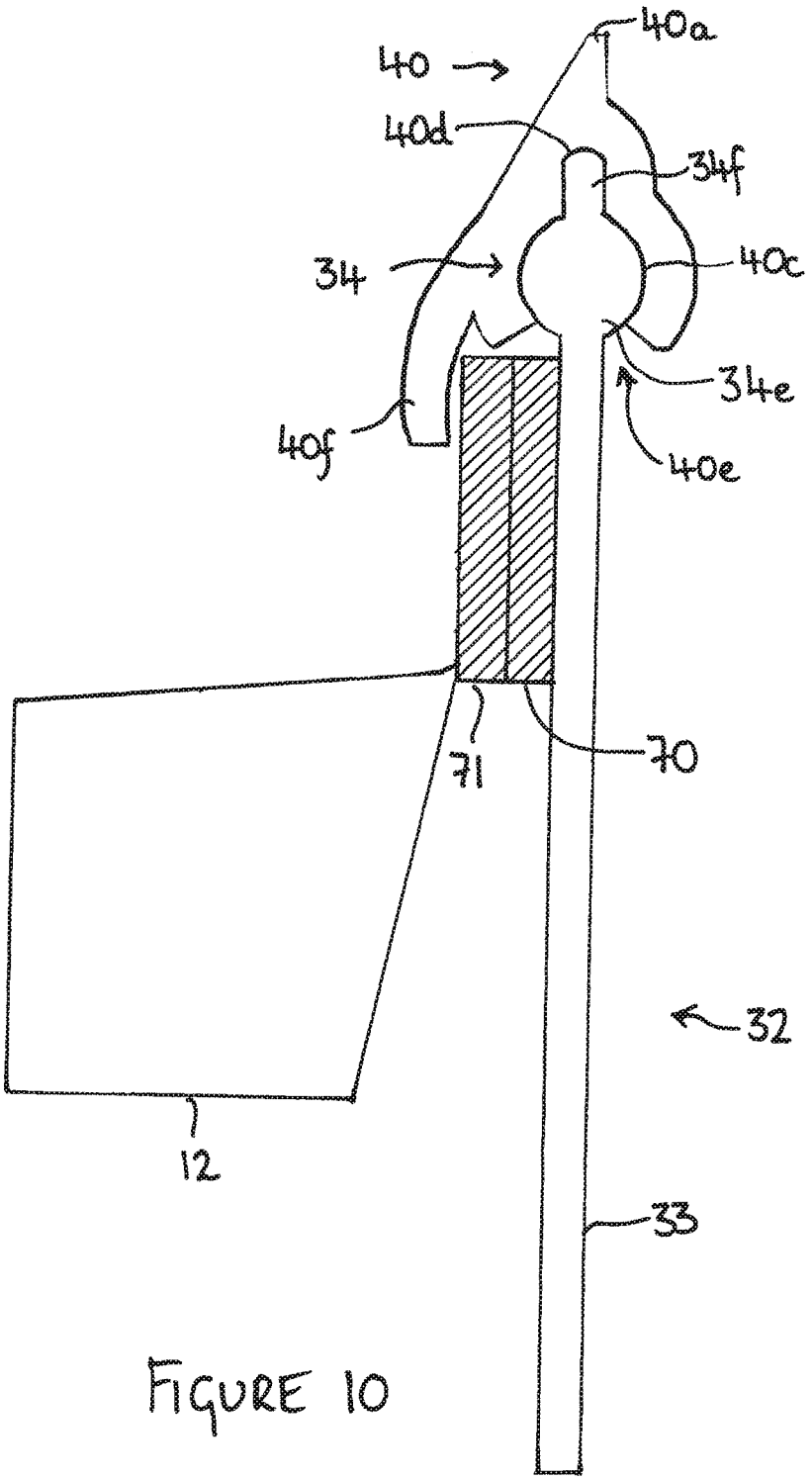
FIG. 10 is a schematic side view of a waste catchment system of an alternative embodiment of the invention.
Figure 11:
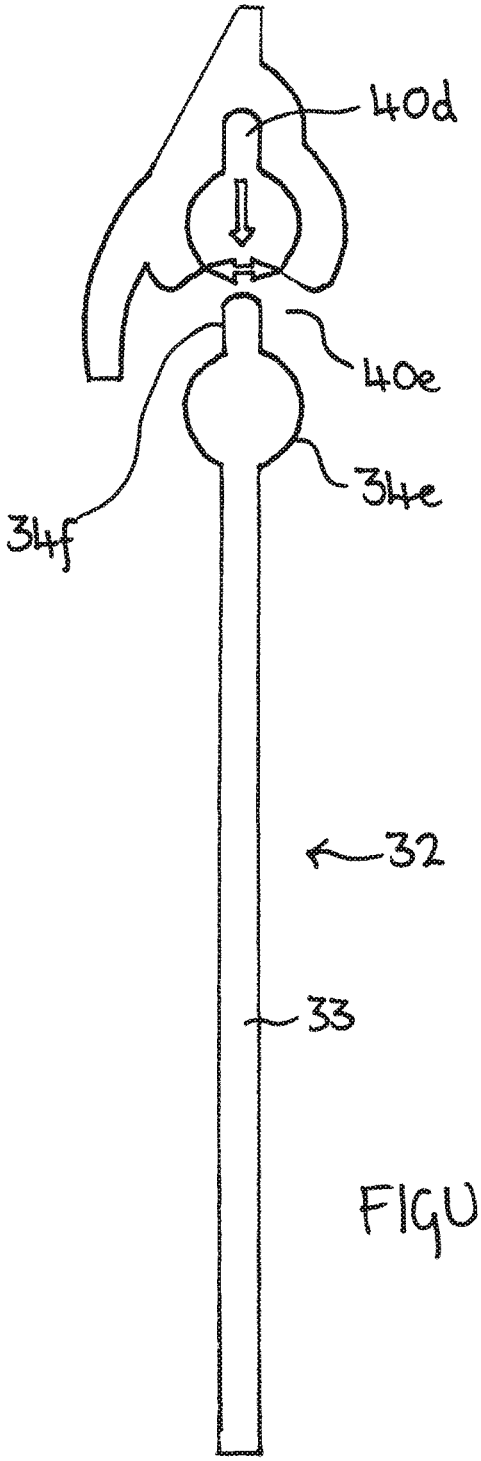
FIG. 11 is a schematic side view of the wiper blade of the waste catchment system illustrated in FIG. 10.

FIGS. 10 and 11 illustrate a further alternative embodiment of the invention. In this embodiment of the invention the blade holder 34 includes a portion 34*e* of substantially circular cross-section, thereby providing protrusions extending from the surface of the support plate 33. The blade 40 includes a recess 40*c* which is configured to receive the portion 34*e*.

In use, the edge 40*a* engages the roller to remove waste therefrom. Torque transmitted from the roller to the blade 40 would tend to rotate the blade 40 about the portion 34*e*. In order to resist such rotational forces, the blade holder 34 includes a element 34*f* which extends into a recess 40*d*.

The recess 40*c* includes an opening 40*e*. The blade holder is pressed into the recess through the opening, the opening deforming to allow passage of the portion 34*e*. The material from which the blade is formed: plastic, rubber or polyurethane for example allows for deformation of the opening 40*e* for the purposes of both inserting the blade holder 34 into the recess 40*c* and removing the blade holder 34 from the recess 40*c*. Further, the material from which the blade 40 is made and the configuration of the recess 40*c* ensure that the blade holder 34 is gripped by the blade 40 when the portion 34*c* sits in the recess 40*c*.

The blade 40 also includes a lip 40*f* that extends beyond the opening 40*e* of the recess 40*c*. As can be seen from FIG. 10, the lip 40*f* extends sufficiently that waste removed from a roller cannot find its way to the attachment of magnetic element 70 to the blade support or the magnetic element 70 to the magnetic element 71.

Figure 12:
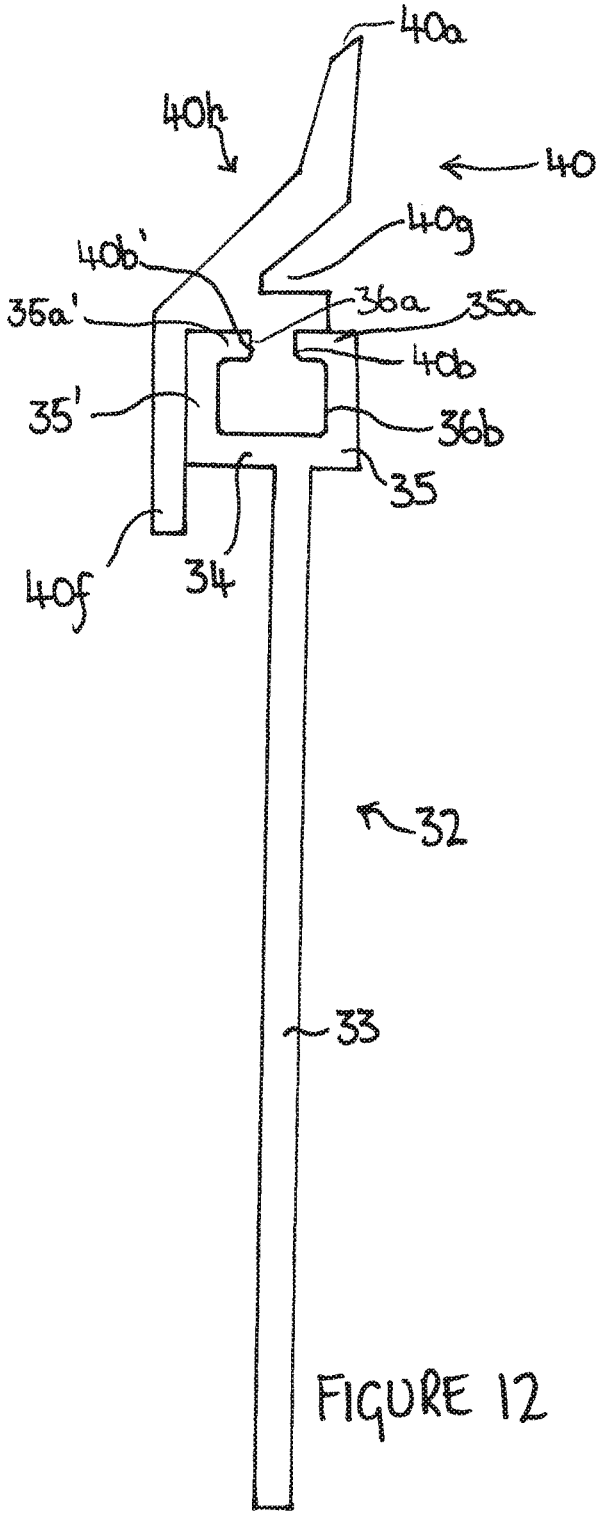
FIG. 12 is a side view of another embodiment of the invention.
Figure 13:
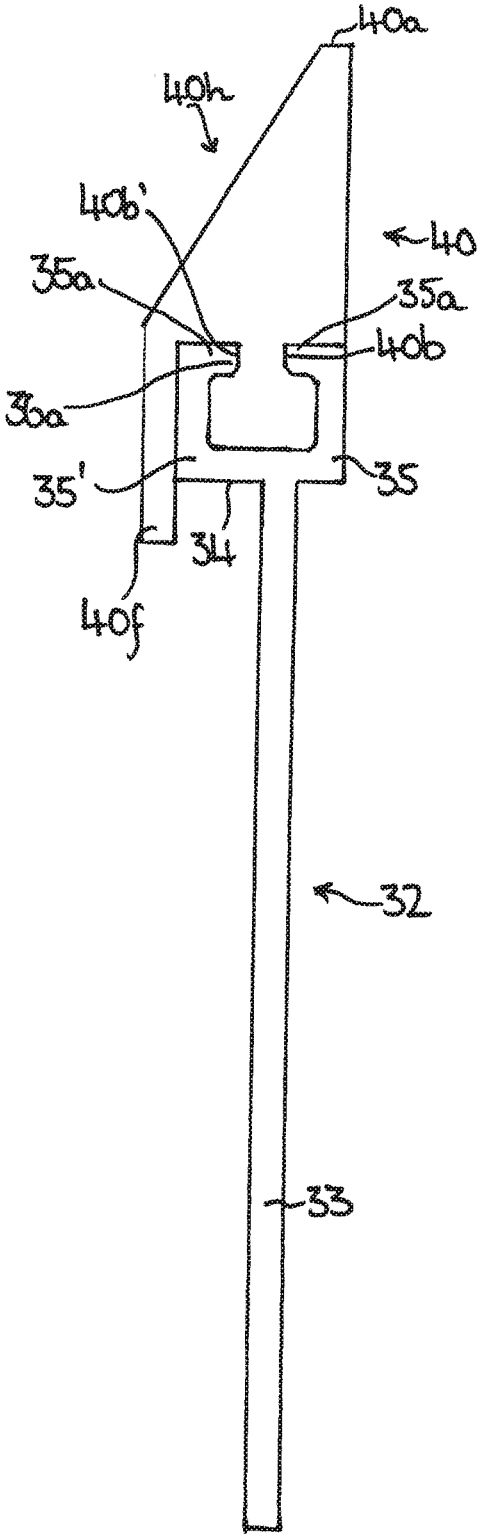
FIG. 13 is a side view of a variation of the embodiment illustrated in FIG. 12.

FIGS. 12 and 13 illustrate an alternative embodiment of the invention. Whereas in the embodiment of the invention illustrated in FIGS. 10 and 11 the blade 40 is pressed on to the blade holder 34, in FIGS. 12 and 13 the blade slides into the blade holder 34 forms a channel for receiving the blade 40 which slides into the blade holder 34 laterally, in a similar manner to the embodiment shown in FIG. 3. However, in the embodiment illustrated in FIGS. 12 and 13, the channel is formed in the blade holder 34 by legs 35, 35' and portions 35*a*, 35*a'* which extend towards each other from the free ends of legs 35, 35'. The legs 35, 35' and the portions 35*a*, 35*a'* form first and second channel portions 36*a*, 36*b*, the first channel portion 36*a* being smaller than the channel portion 36*b*. The portions 35*a*, 35*a'* extend into respective recesses 40*b*, 40*b'*. Hence, when the blade 40 is inserted into the blade holder 34 the blade 40 is constrained in the longitudinal direction of the blade assembly 32.

The blade 40 in the embodiment of FIG. 12 is formed from a plastic material, whereas in the embodiment shown in FIG. 13 the blade is formed of rubber. The blade 40 in FIG. 12 includes a recess 40*g*, which provides the blade 40 with a degree of flexibility so that the edge 40*a* of the blade 40 may engage with the roller with sufficient force to remove ink therefrom. The embodiment shown in FIG. 13, being formed from rubber, has sufficient resilience that the recess 40*g* is not required. In both the FIGS. 12 and 13 embodiments, the lip 40*f* and the edge 40*a* are connected to one another by a surface 40*h*, which carries ink from the edge 40*a* to the lip 40*f*. Ink falls off the lip 40*f* into a liner of a wash up tray, for example, the same manner as shown in FIGS. 9 and 10. It is preferred that the means of attachment of the liner to the blade assembly is as shown in FIGS. 9 and 10.

The surface 40*h* lies on two intersection planes, whereas in FIG. 13 the surface 40*h* lies in a single plane.

One end of the blade holder 34 may be closed and the other may be provided with a locking means. For example, the blade 40 may be introduced and removed from the blade holder 34 and also held in place in the blade holder in the manner as described with reference to FIGS. 5*a* to 5*c*.

Although the invention is described above with reference to different preferred embodiments, the features found in one embodiment are not necessarily exclusive to the embodiment in which they are shown. Features of different preferred embodiments may be combined.

The invention claimed is:

1. A blade assembly of a waste ink catchment system for a printing press roller, the blade assembly comprising a support plate for attachment to a wash up tray of the waste catchment system, the support plate including a blade holder, and a blade mounted in the blade holder, wherein the blade has a longitudinal axis and a free edge which extends in the direction of the longitudinal axis and which is adapted to engage with the ink roller to be cleaned, characterised in that the blade holder is configured to receive and retain the blade, the blade being removably attachable to the blade holder such that the blade is removable from the blade holder and replaceable with a new blade without removal or replacement of the blade holder, the blade assembly further comprising blade retaining means associated with the blade holder, said blade retaining means having a first position in which the blade is slidable relative to the blade holder, and a second position in which the blade retaining means prevents sliding of the blade out of the blade holder, the blade holder and the blade comprising fixed respective co-operating elements configured to constrain the blade against movement relative to the blade holder in direction perpendicular to the longitudinal axis of the blade, the blade assembly further comprising a sloping surface configured to direct waste ink removed from the roller by the blade towards and into the wash up tray.

2. A blade assembly according to claim 1, wherein removable attachment of the blade to the blade holder is provided by the blade being insertable into and removable from the blade holder by sliding with respect thereto, the blade holder and the blade comprising respective co-operating elements configured to permit sliding of the blade relative to the blade holder in the longitudinal direction of the blade and to constrain the blade against movement relative to the blade holder in a direction perpendicular to the said longitudinal axis.

3. A blade assembly according to claim 2, wherein the blade holder includes a channel, the blade received and retained in the channel.

4. A blade assembly according to claim 1, wherein the co-operating elements include at least one indent in one of the blade and the blade holder and at least one protrusion so shaped and dimensioned as to engage the at least one indent to slide in the longitudinal direction of the indent.

5. A blade assembly according to claim 1, wherein the blade holder includes a closed end adapted to limit sliding of the blade relative to the blade holder.

6. A blade assembly according to claim 1, wherein the sloping surface is configured to engage the blade and direct waste material removed from the roller by the blade towards the wash up tray and forwards of a face of the support plate that is adjacent the wash up tray.

7. A blade assembly according to claim 6, wherein the sloping surface is a part of one of: the blade holder and a component mounted in the blade holder.

8. A blade assembly according to claim 1, wherein the blade assembly is adapted to attach to a liner for lining the tray.

9. A blade assembly according to claim 8, wherein the blade assembly and one edge of the tray are provided with respective co-operating male and female elements, the male and female elements providing a releasable sealing connection therebetween.

10. A blade assembly according to claim 8, wherein the blade assembly is attached to the liner magnetically.

11. A blade assembly according to claim 10, wherein each of the blade assembly and the liner is provided with a magnetic element, wherein each magnetic element provides alternating north/south polarities and wherein the magnetic elements are arranged on the blade assembly and the liner so that when the opposing polarities of the respective magnetic elements align, a free edge of the wash up try liner is situated in a channel behind a lip formed at an edge of the sloping surface configured to direct waste ink removed from the roller by the blade towards and into the wash up tray.

12. A blade assembly according to claim 1, wherein the co-operating elements comprise a recess in the blade and the blade holder includes a protrusion, the protrusion engaging in the recess.

13. A blade assembly according to claim 12, wherein the blade includes an indent extending from the recess and wherein the blade includes an element for engaging with the indent.

14. A blade assembly according to claim 12, wherein the blade holder includes a channel, and the blade includes a portion configured to be seated in the channel.

15. A blade assembly according to claim 12, wherein the blade includes the sloping surface configured to engage the roller and direct waste material removed from the roller by the blade towards the wash up tray and forwards of a face of the support plate that is adjacent the wash up tray.

16. A blade assembly according to claim 15, wherein the sloping surface is formed in part by a lip extending from the blade.

17. A blade assembly according to claim 16, wherein the blade assembly is adapted to attach to a liner for lining the tray and wherein the lip is configured so that it extends beyond an attachment member attaching the blade assembly to the liner.

18. A waste catchment system for a roller comprising an elongate tray, and a blade assembly as claimed in claim 1 attached to the tray to extend the length thereof.

19. A waste catchment system according to claim 18, wherein the blade assembly is adapted to attach to a liner for lining the tray, the waste catchment system further comprising a liner for lining the tray, the blade assembly releasably attachable to the liner.

* * * * *